US008522457B2

(12) United States Patent
Scholz et al.

(10) Patent No.: US 8,522,457 B2
(45) Date of Patent: Sep. 3, 2013

(54) SOLE

(75) Inventors: Wolfgang Scholz, Lonnerstadt (DE); Jurgen Weidl, Aurachtal (DE)

(73) Assignee: adidas International Marketing B.V., Amsterdam (NL)

( * ) Notice: Subject to any disclaimer, the term of this patent is extended or adjusted under 35 U.S.C. 154(b) by 662 days.

(21) Appl. No.: 12/645,452

(22) Filed: Dec. 22, 2009

(65) Prior Publication Data

US 2010/0154258 A1 Jun. 24, 2010

(30) Foreign Application Priority Data

Dec. 23, 2008 (DE) ..... 10 2008 064 493

(51) Int. Cl.

| | |
|---|---|
| ***A43B 1/10*** | (2006.01) |
| ***A43B 5/02*** | (2006.01) |
| ***A43B 13/18*** | (2006.01) |
| ***A43B 13/38*** | (2006.01) |

(52) U.S. Cl.

USPC ..... 36/102; 36/128; 36/44; 36/30 R; 36/25 R

(58) Field of Classification Search

USPC ..... 36/102, 128, 44, 30 R, 25 R

See application file for complete search history.

(56) References Cited

U.S. PATENT DOCUMENTS

| | | | | |
|---|---|---|---|---|
| 2,224,590 | A * | 12/1940 | Boivin | 36/3 B |
| 2,381,937 | A * | 8/1945 | Supple | 36/33 |
| 2,508,392 | A * | 5/1950 | Issaly | 36/30 R |
| 2,897,611 | A | 8/1959 | Schaller | |
| 3,976,059 | A | 8/1976 | Lonardo | |
| 4,059,910 | A * | 11/1977 | Bryden et al. | 36/103 |
| 4,476,638 | A * | 10/1984 | Quacquarini et al. | 36/86 |
| 4,547,981 | A | 10/1985 | Thais et al. | |
| 4,608,970 | A | 9/1986 | Marck et al. | |
| 4,779,361 | A * | 10/1988 | Kinsaul | 36/102 |
| 4,922,631 | A | 5/1990 | Anderie | |
| 5,452,526 | A | 9/1995 | Collins | |
| 5,542,195 | A * | 8/1996 | Sessa | 36/28 |
| 5,720,117 | A | 2/1998 | Toschi | |
| 6,708,426 | B2 | 3/2004 | Erickson et al. | |
| 6,708,427 | B2 | 3/2004 | Sussmann et al. | |
| 6,715,218 | B2 | 4/2004 | Johnson | |
| 7,143,529 | B2 | 12/2006 | Robinson, Jr. et al. | |
| 7,421,805 | B2 | 9/2008 | Geer | |
| 8,082,682 | B2 * | 12/2011 | Karl et al. | 36/8.3 |
| 8,272,149 | B2 * | 9/2012 | Cooper et al. | 36/102 |
| 2005/0246922 | A1 | 11/2005 | Gibert et al. | |
| 2007/0000149 | A1 * | 1/2007 | Juniman | 36/8.3 |
| 2007/0107265 | A1 | 5/2007 | Mueller et al. | |

FOREIGN PATENT DOCUMENTS

| | | |
|---|---|---|
| DE | 20 22 974 | 11/1971 |
| DE | 1 973 891 | 11/1976 |
| DE | 3 219 652 | 12/1983 |
| DE | 3 516 545 | 11/1986 |

(Continued)

*Primary Examiner* — Ted Kavanaugh

(74) *Attorney, Agent, or Firm* — Sterne, Kessler, Goldstein & Fox P.L.L.C.

(57) ABSTRACT

A sole for a shoe, in particular a sports shoe, includes a unidirectional bending element. The unidirectional bending element enables a dorsal bending of the sole (bending of the sole in the direction upward and away from the ground) and blocks a plantar bending of the sole (bending of the sole in the direction downward and towards the ground). The unidirectional bending element may be arranged at a first layer of the sole and may vertically project from the first layer.

26 Claims, 5 Drawing Sheets

(56) References Cited

FOREIGN PATENT DOCUMENTS

| | | | | |
|---|---|---|---|---|
| DE | 201 10 084 | | | 11/2001 |
| DE | 10 2008 020 890 | | | 10/2009 |
| EP | 997081 | A1 | * | 5/2000 |
| EP | 1 074 194 | | | 2/2001 |
| EP | 1 561 390 | | | 8/2005 |
| GB | 2156652 | A | * | 10/1985 |

* cited by examiner

SOLE

BACKGROUND OF THE INVENTION

1. Field of the Invention

The present invention relates to a sole for footwear, in particular for athletic shoes such as, for example, European football (i.e., soccer) shoes.

2. Background Art

Sports shoes are multi-functional. They fulfill a particular function in a respective discipline by supporting a particular movement or by providing good contact with the ground. They also function to protect the foot from exterior impact or to prevent wrong movements, in order to avoid injuries.

Risks of this kind arise in European football (i.e., soccer) when the player gets in contact with a ball. During this contact, enormous forces may act on the instep of the foot which hyperextend the foot in the direction of the sole (plantar), for example during a shot or when the opponent blocks the ball. In an extreme case, a player already having a high running speed may get his foot stuck in the ground. This leads to a sudden blocking of this high speed movement. The blocking may cause a plantar hyperextension of the foot and may lead to a painful injury.

The risk of such a plantar hyperextension could be effectively avoided by a rigid sole; on the other hand, this would disable the football shoe for fast movements since a rigid sole impedes an elastic rolling-up of the foot.

Several attempts have been made in order to provide a sole which is rigid against plantar hyperextension while simultaneously enabling rolling-up of the foot. Such attempts are also known for other areas of the shoe or for gloves.

The German utility model DE 19 73 891 describes a European football shoe which provides grooves in the area of the metatarsal whose side walls are provided with a layer which is harder than the material of the sole (see FIGS. 1 to 4). It is further suggested to also improve rigidity in the forefoot area by providing an extension away from the sole transverse to the longitudinal direction of the sole.

Similarly, the German patent DE 32 19 652 describes a European football shoe whose sole has areas with different degrees of hardness and which are arranged in the forefoot area. Recesses or grooves transverse to the sole are provided in order to save weight.

Further, the European patent application EP 1 074 194 discloses a structure for a sole in which alternating soft and hard elements are arranged as transverse grooves in a layer of a sole.

The published patent application US 2007/0107265 discloses a flexible sole with segments in the metatarsal area which can be articulated. However, this application is based on a problem opposite to that of the present application, namely to support a strong bending of the arch of the foot, for example during dancing.

Further, U.S. Pat. No. 6,715,218 describes a support device which is flexible in one direction and which is rigid in a different direction. This device can be incorporated into a variety of articles of sports equipment, such as sports shoes.

The German patent application DE 35 16 545 describes a goal keeper glove with elements on the backside of the hand, in order to avoid a hyperextension of the fingers to the back side.

The previous solutions against plantar hyperextension of the foot are not satisfactory since they impede the movability of the wearer of the shoe and do not fulfill general biomechanical requirements to allow smooth movements. Further, the manufacture of the described devices is complex.

It is therefore the problem of the present invention to overcome the disadvantages discussed above and to provide in particular a sole which avoids plantar hyperextension of the foot without limiting the movability during use of the shoe. Further, the sole shall be manufactured easily.

BRIEF SUMMARY OF THE INVENTION

The present invention addresses this problem in a first embodiment with a sole for a shoe, in particular a sports shoe, wherein the sole comprises a unidirectional bending element. The unidirectional bending element enables a dorsal bending of the sole and blocks a plantar bending. Dorsal bending, as used herein, is defined as a bending of the sole in the direction upward and away from the ground. Plantar bending, as used herein, is defined as a bending of the sole in the direction downward and towards the ground. The width of the unidirectional bending element may be less than half of the width of the sole. For simplicity, the unidirectional bending element is designated as bending element in the following.

Unlike the prior art, the present invention not only provides protection from a hyperextension of the foot, but also high movability for a user of the shoe. As noted above, the known solutions for preventing hyperextension of the foot impede the movability of the user of the shoe since the known elements for reinforcing a sole comprise a significant part of the width of the sole and thereby hamper a lateral rolling-up of the foot. Such lateral movements occur in particular within lateral sports such as football, for example when the player performs many directional changes in his movement during dribbling. The directional changes require lateral rolling-up of the foot from a medial edge to a lateral edge of the foot and vice versa.

By contrast, a "slim" bending element which extends across less than half of the width of the sole minimizes hyperextension of the foot while also enabling a lateral rolling-up of the foot since the sole is less rigid than the bending element.

In some embodiments, the bending element may be located along a center line of the sole. Such a central arrangement enables a uniform rolling-up on both sides. Still, such a sole fulfils the requirements to avoid a hyperextension of the foot. In some embodiments, the bending element is arranged in the forefoot area in order to protect this particularly sensitive area of the foot.

In some embodiments, the width of the bending element may be less than a third of the width of the sole. In this embodiment, lateral rolling-up is in addition improved by further reducing the width of the bending element. Thereby the area of the sole with reduced elasticity, namely the area of the bending element, is limited correspondingly.

In some embodiments, the width of the bending element may vary along a longitudinal axis of the sole. By adjusting the width of the bending element to vary with the width of the sole in this way, a uniform lateral rolling-up is enabled.

In some embodiments, the bending element may extend to an area of the toes of the sole. In order to provide high movability during sports, it is on one hand desirable to have a shoe with a high elasticity. On the other hand, the flexibility leads to the particular risk of plantar hyperextension of the sensitive toes. Extending the bending element to the area of the toes therefore improves the protection of the toes and simultaneously enables lateral rolling-up of the sole also in this area.

In a second embodiment, a unidirectional bending element enables a dorsal bending of the sole and blocks a plantar bending of the sole. The unidirectional bending element may be arranged at a first layer of the sole and may vertically project from the first layer. In some embodiments, the bending element may be arranged on a side of the first layer away from the foot.

This embodiment may result in a unidirectional bending element enabling a modular assembly of a sole. In the prior art, it is only known to modify a whole reinforcing layer of a sole which requires a complex manufacture. In contrast to this, the unidirectional bending element of this embodiment may enable a modular manufacture. This is made possible by arranging the bending element on a first layer of the sole, wherein the bending element vertically projects from the first layer. In this way, the bending element can be separately manufactured and subsequently attached to a layer of a sole. Since the bending element vertically projects from the first layer, the layer itself can be significantly thinner than the bending element. Therefore, neither a particular reinforcement of the sole is required, nor does the sole have to have a minimum thickness. This is particularly advantageous if the layer of the sole is an insole which therefore can be significantly thinner than the bending element.

In this embodiment, the width of the bending element may comprise less than half of the width of the sole. This leads to the same advantages described above in connection with the first embodiment.

The bending element may be arranged in a recess or opening of the first layer. This enables a proper integration of the bending element with the first layer. For example, the bending element can be separately manufactured and subsequently arranged in a mold for injection molding. The first layer of the sole may then be manufactured by injection molding around the bending element. In this way, the bending element itself serves as a mould for the recess or opening in the first layer of the sole.

In various embodiments, the sole may be an inlay sole, an insole or an intermediate sole. In a further embodiment, the sole is an outsole, wherein the bending element may be covered by a transparent material, in order to protect the bending element.

In some embodiments, the sole comprises a second layer, wherein the second layer comprises an indentation for the bending element. In this way, the bending element can be integrated into the sole. In contrast to the prior art, this only requires an indentation in a second layer of the sole. This is significantly simpler than a design in which a whole layer of a sole is designed as an reinforcing element.

In some embodiments, the indentation has a shape corresponding to the bending element. This fixes the first layer with the bending element connected thereto with respect to the second layer and avoids slipping.

In some embodiments, the first layer may be an inlay sole or an insole and the second layer may be an insole or an intermediate sole. In an alternative embodiment, the first layer may be an insole or an intermediate sole and the second layer may be an outsole. These examples show that the claimed sole can be realized in many different ways.

If the second layer is an outsole, then the outsole may comprise a transparent area through which the bending element is visible. This allows an optical control of the function of the bending element and permits a check of the selection of the bending element in case the bending element is exchangeable. For example, different colors may index different properties of the exchangeable bending elements and enable discrimination. The transparent area enables recognition of the specific bending element in use. Further, it is conceivable that the bending element may be releasably attached (for example using a clip system) to the outside of the outsole. In this embodiment it is particularly simple to exchange the bending element from the outside without having to take off the shoe.

In a further embodiment, the bending element comprises blocks which are separated by indentations. The indentations preferably run orthogonal to a longitudinal axis of the bending element. In some embodiments the bending element further comprises a plastic plane to which the blocks are attached. The indentations therefore act as hinges between the blocks and enable bending of the bending element.

In some embodiments, the distances between adjacent indentations in the direction of the longitudinal axis of the bending element may be smaller than the widths of the blocks in the direction orthogonal to the longitudinal axis of the bending element. This causes stability orthogonal to the longitudinal axis of the bending element and further ensures that bending of the bending element is essentially limited to a bending plane which runs orthogonal to the plane of the bending element along the longitudinal axis of the bending element.

In further embodiments, the angles formed between the indentations and the longitudinal axis may not be equal to 90° and/or may be different from each other. In these embodiments, the bending of the bending element deviates from the previously described bending plane and leads to a torsion away from the bending plane. This can be advantageous to support but also to limit particular movements. For example, a natural rolling-up of the foot in one direction can be supported, and an undesired contortion of the foot (sprain) in a different direction can be avoided.

In a further embodiment, the blocks of the bending element comprise materials of different properties, such as, for example, elasticity. This avoids a sudden blocking of the plantar bending of bending element but rather leads to first moderating the plantar bending before blocking it. This bending process can be regulated by properties of the material.

In some embodiments, the distances between adjacent indentations between the blocks are different. In particular together with the use of materials of different properties, this results in further possibilities to regulate the damping of the bending element during a plantar movement. For example, single blocks of the bending element may comprise a higher elasticity than others which results in a soft transition between the movement range in which the bending element is bendable and the movement range in which it blocks.

A further embodiment relates to a corresponding shoe which comprises an indentation for a bending element of an inlay sole. In this way, a shoe can be equipped in a particularly simple way with a bending element. Since it is an inlay sole, the bending element can be easily exchanged together with the inlay sole. This allows to choose between bending elements having different bending properties.

In a further embodiment, a sole for an article of footwear may include a unidirectional bending element having a base and a plurality of blocks extending from the base. The plurality of blocks may be separated by indentations extending across a width of the unidirectional bending element. The plurality of blocks may be arranged such that when the plurality of blocks are moved in a dorsal direction, the plurality of blocks are capable of moving away from each other to thereby permit a dorsal bending of the sole and when the plurality of blocks are moved in a plantar direction, the plurality of blocks contact each other to impede movement to thereby restrict plantar bending of the sole. The width of the unidirectional bending element may also be less than half a width of the sole.

BRIEF DESCRIPTION OF THE DRAWINGS/FIGURES

In the following, aspects of embodiments of the present invention are described in more detail with respect to the accompanying figures. These figures show:

DETAILED DESCRIPTION OF THE INVENTION

In the following, embodiments of the present invention are described in more detail with respect to an example of a sole for a shoe, in particular for a European football (i.e., soccer) shoe. However, it is to be understood that the present invention is not limited to a sole for a football shoe but can be applied to other sports shoes and shoes in general, in order to avoid a plantar bending of the sole and hyperextension of the foot without limiting the movability of the sole (and foot) during use of the shoe.

Figure 1:
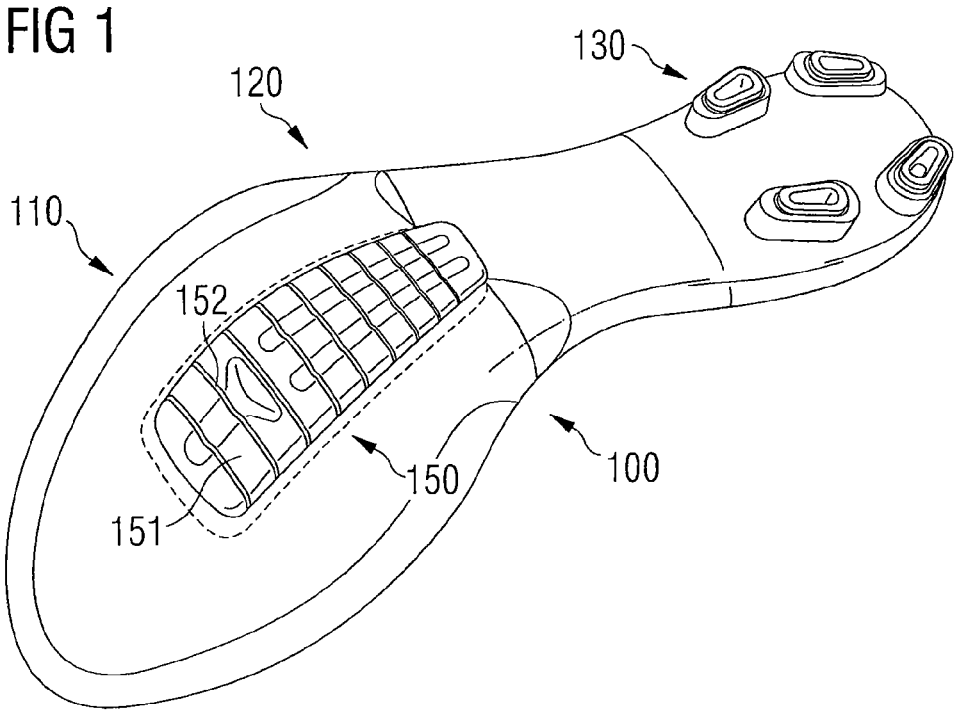
FIG. 1 is a perspective bottom view of an embodiment of a sole for a shoe with a bending element.

FIG. 1 shows a perspective bottom view of an embodiment of sole 100 for a shoe having a bending element. In the figure, an insole for a football shoe with a forefoot area 110, a metatarsal area 120 and a heel area 130 can be recognized. For simplicity, the insole is designated as sole 100 in the following description. In forefoot area 110 of sole 100 a bending element 150 may be arranged which may essentially extend along a center line of sole 100. The center line may run in a longitudinal direction of sole 100 and may have an essentially equal distance to both edges of sole 100. In alternative embodiments (not illustrated) the bending element is arranged in other areas of the sole, for example in metatarsal area 120, or extends across several areas, for example across metatarsal area 120 and forefoot area 110. Further, bending element 150 can be shifted and/or skewed with respect to the center line of the sole.

At every point of the bending element 150, the width of the bending 150 may be substantially smaller than the width of sole 100 at the same point. In the view of FIG. 1, it can be recognized that the width of bending element 150 may be less than half of the width of sole 100. In a further embodiment (not illustrated), the width of bending element 150 may be less than a third of the width of sole 100. Since sole 100 is less rigid than bending element 150, this facilitates bending in a transverse direction of the sole. This enables a lateral rolling-up of the foot during use of a shoe having this sole which significantly improves the movability.

FIG. 1 further shows that bending element 150 may comprise a plurality of blocks 151 separated by indentations 152. Blocks 151 may be any shape including, but not limited to, square, rectangular, polygonal, and round. Indentations 152 may be essentially straight in a top view and may run orthogonal to a longitudinal axis of bending element 150. Indentations 152 may permit bending element 150 and sole 100 attached thereto to be bent in the dorsal direction, i.e. upwards and away from the ground when worn, of sole 100 (in FIG. 1 downwards). Bending in the opposite, i.e. plantar direction, downwards and towards the ground when worn (in FIG. 1 upwards) is, however, not possible since the side walls of blocks 151 come into contact with each other during bending in the plantar direction and therefore block further bending in the plantar direction. Thus, bending element 150 may permit dorsal bending of sole 100 because blocks 151 may be moved away from each other (increasing the size of indentations 152 in a direction of the longitudinal axis of bending element 150) and may limit plantar bending of sole 100 because the side walls of block 151 contact each other when moved in the plantar direction to impede further movement of blocks 151.

The distances between adjacent indentations 152 in the direction of the longitudinal axis of bending element 150 may be smaller, in some embodiments multiple times smaller, than the widths of blocks 151 in the direction orthogonal to the longitudinal axis of bending element 150, as can also be recognized in FIG. 1. This ensures stability of the bending element 150 in the direction orthogonal to its longitudinal axis and further ensures that bending of the bending element 150 is essentially limited to a bending plane which runs orthogonal to the plane of bending element 150 along the longitudinal axis of bending element 150.

In alternative embodiments (not illustrated) indentations 152 may be essentially not orthogonal to the longitudinal axis of bending element 150. Further, the angles formed between indentations 152 and the longitudinal axis of bending element 150 can be different from each other. In these embodiments, the bending of bending element 150 deviates from the previously described bending plane and leads in particular to a torsion beyond the bending plane. This can be advantageous for a support but also a limitation of particular movements. In further embodiments (see below in FIG. 8) the indentations of the bending element are curved in a bottom view or a top view. The curved indentations may reduce the risk of shearing during torsion.

In further embodiments, blocks 151 of bending element 150 may comprise materials of different properties, such as, for example, different elasticity. Elasticity and weight of the bending element may influence, for example, the power of a kicked ball. An example for a particularly well suited material may be Polyamide PA 6. This may allow controlled deceleration and blocking of bending element 150 during plantar bending of sole 100. For example, single blocks 151 of bending element 150 may be more elastic than other blocks so that there is a soft transition between the movement range in which bending element 150 is bendable and the movement range in which it blocks.

FIG. 1 further shows that the width of bending element 150 may vary along the longitudinal axis of sole 100. In particular, bending element 150 may have a larger width in areas where sole 100 has a larger width, and bending element 150 may have a smaller width in where sole 100 has a smaller width. By adjusting the width of bending element 150 in this way to correspond with the varying width of sole 100, a uniform lateral rolling-up is enabled since the portion of the sole width free from the bending element 150 and in which the sole is more elastic than in the area of the bending element 150, remains approximately constant.

FIG. 1 further shows that bending element 150 may vertically project from the first layer of sole 100. When connecting sole 100 to a second layer of the sole, i.e. an intermediate sole or an outsole (e.g. outsole 160), the second layer may comprise an indentation (e.g. indentation 162) which may correspond to the shape of bending element 150.

In various embodiments (not shown), sole 100 illustrated in FIG. 1 is not only an insole, but also an intermediate sole or an outsole. If it is an outsole, the bending element can be arranged in one embodiment on the side of the outsole away from the foot. In this case, the bending element may be protected by a preferably transparent cover. In a further embodiment, the bending element may be arranged on the side of the outsole directed towards the foot. In this case, the sole layer arranged on the side of the bending element comprises an indentation for receiving the bending element.

Figure 2:
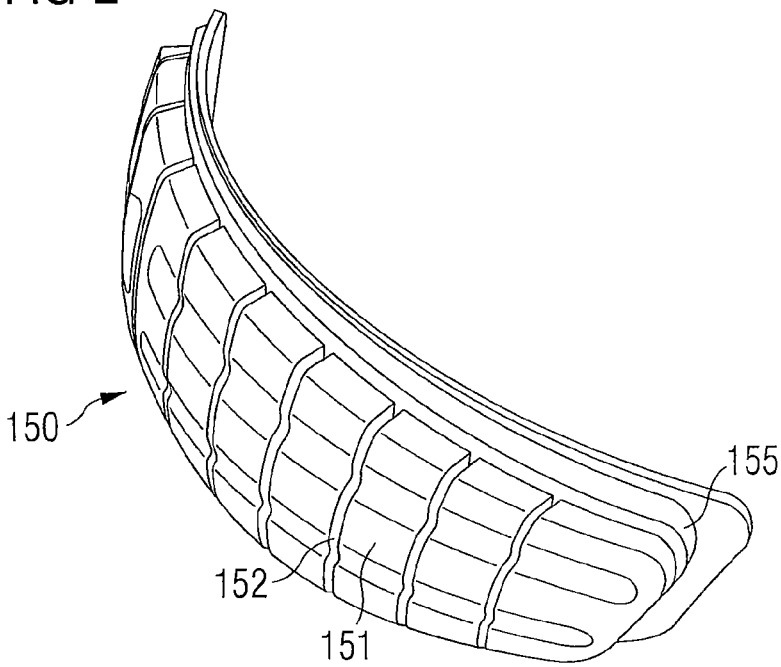
FIG. 2 is a perspective view of the bending element from FIG. 1.

FIG. 2 is a perspective view of the bending element of FIG. 1. Bending element 150 with blocks 151 and indentations 152 between blocks 151 can be recognized. Further, a plastic plane 155 can be recognized to which blocks 151 are attached. Plastic plane 155 extends beyond the area of blocks 151 and can be used for connection with a sole, as explained in more detail in connection with the description of FIG. 3. FIG. 2 also shows that bending element 150 may be curved in the initial state. In an alternative embodiment (not illustrated), the blocks may be connected to each other by a circumferential plastic strap.

Bending element 150 may be injection-molded in one piece. This may comprise one-component injection molding or multi-component (different materials) injection molding. The pre-curvature of the bending element may be created during the manufacturing process in which the indentations may be generated by mold slides (in the curved state the indentations are "open"). The mold slides can be arranged in parallel and may therefore be taken out in a single direction. The dorsal pre-tension further supports the rolling-up properties of the sole and minimizes a blocking tolerance. This will be explained in more detail in connection with FIG. 3.

Figure 3:
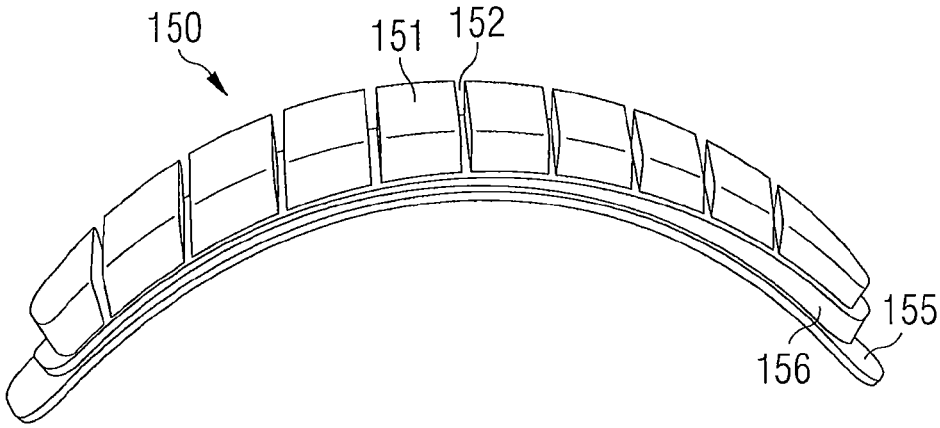
FIG. 3 is a further perspective view of the bending element from FIG. 1.

FIG. 3 is a further side view of the bending element from FIG. 1 and FIG. 2. Bending element 150 with blocks 151 and indentations 152 as well as plastic plane 155 can be recognized in FIG. 3. In this view it is clearly visible that bending element 150 may be curved in its initial state.

It is further illustrated that indentations 152 may be essentially parallel in their initial state in the side view of FIG. 3. Bending element 150 may therefore be manufactured in a simple way by an appropriate method using a mold. Indentations 152 may be formed by placing mold slides inside the mold. The result is bending element 150 which is curved in its initial state.

Therefore, in order to flatten bending element 150, an external force is required. Conversely, in the flat state a force acts to return the bending element to the curved state. As a result, rolling-up of the foot is supported along the longitudinal axis of bending element 150.

FIG. 3 further shows that plastic plane 155 may be graded and comprises an area 156 with a larger thickness. The thickness of graded area 156 may vary along bending element 150 and increases in particular from the forefoot area to the midfoot area (i.e., from left to right in FIG. 3). This property is relevant when connecting the bending element to a sole, for example an insole, as explained in the following.

Bending element 150 can be arranged in an indentation of a sole, for example an inlay sole, an insole, an intermediate sole or an outsole, and attached to the sole. In one embodiment, the sole is manufactured using an appropriate method, for example injection molding, around bending element 150, so that bending element 150 itself forms a mold for the indentation.

In one embodiment, plastic plane 155 may form part of the surface of sole 100, and the thickness of sole 100 corresponds to the thickness of graded area 156. Therefore, the area of plastic plane 155 up to graded area 156 may be available as surface for a connection to sole 100 and therefore provides a good bonding surface. A variable thickness of graded area 156 therefore leads to a correspondingly varying thickness of sole 100. Bending element 150 shown in FIG. 3 would lead to a thickness of a sole attached thereto which increases from the forefoot area to the midfoot area, corresponding to the thickness of graded area 156.

Figure 4:
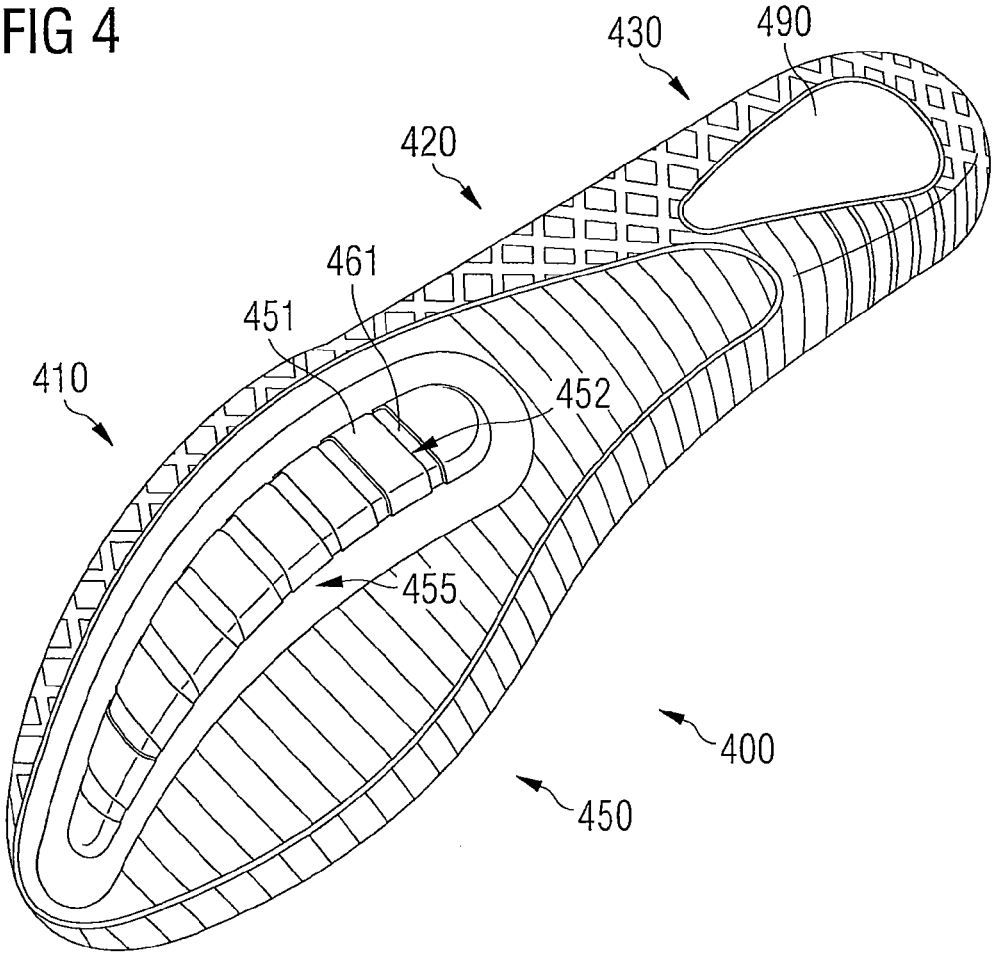
FIG. 4 is a perspective bottom view of a further embodiment of a sole for a shoe with a bending element.

FIG. 4 is a perspective bottom view of a further embodiment of a sole 400 for a shoe with a bending element. The figure shows an inlay sole, in particular for a football shoe, having a forefoot area 410, a metatarsal area 420 and a heel area 430. A bending element 450 may be arranged in forefoot area 410 of the inlay sole. Bending element 450 may extend on the one side to the area of the toes and on the other side to metatarsal area 420. Bending element 450 may be curved towards the lateral side of inlay sole 400. In alternative embodiments (not illustrated) bending element 450 may be arranged in other areas of sole 400, for example in metatarsal area 420, or it may extend across several areas, for example across metatarsal area 420 and forefoot area 410. Further, the bending element can be curved differently and can be arranged, for example, along a center line of the inlay sole.

At every point of bending element 450, the width of bending element 450 may be substantially smaller than the width of inlay sole at the same point. The statements on the widths of bending element 150 with respect to FIGS. 1 to 3 also apply to the embodiment of FIG. 4.

FIG. 4 also shows that bending element 450 may comprise a plurality of blocks 451, 461 which are separated by indentations 452. Also here the statements on blocks 151 and indentations 152 made with respect to FIGS. 1 to 3 apply. However, other than in FIG. 1, the distances between adjacent indentations 452 along the longitudinal axis of the bending element 450 may be different. In other words, there may be shorter blocks 461 and longer blocks 451. Further, a plastic plane 455 can be recognized to which blocks 451, 461 may be attached.

Bending element 450 can be manufactured by multi-component injection molding so bending element 450 is made from one piece. Alternatively, the bending element could be made from two pieces molded separately which are attached to each other after injection molding. This is described, for example, in U.S. Pat. No. 6,715,218, which was mentioned above.

The different sizes of the blocks 451, 461 play a role when using materials with different properties for regulating the damping of bending element 450. For example, shorter blocks 461 may comprise a material having a larger elasticity than the material of the longer blocks 451. In this way, the transition between the movement range in which bending element 450 is bendable and the movement range in which it blocks is dampened. If longer blocks 451 are made from a material having a larger elasticity than the material of shorter blocks 461, then the damping is even increased.

A bending element 450 with blocks made from different materials can be manufactured in a simple way by multi-component injection molding. For example, plastic plane 455 and blocks 461 may comprise a first material, and blocks 451 may comprise a second material.

Further, it can be recognized in FIG. 4 that a damping element 490 may be arranged in heel area 430.

A further embodiment of the invention (not illustrated) relates to a corresponding shoe which comprises an insole with an indentation for a bending element of an inlay sole. In this way, a shoe can be equipped in a particularly simple way with a bending element. Since it is an inlay sole, the inlay sole together with the bending element can be easily exchanged. Depending on needs and personal preferences, bending elements having different properties with respect weight, stiffness, size etc. can be used. Similarly, defective bending elements can be exchanged at low cost. It is also conceivable that the bending element may be releasably attached to the inlay sole so that, depending on the needs, the bending element or the inlay sole can be exchanged.

Figure 5:
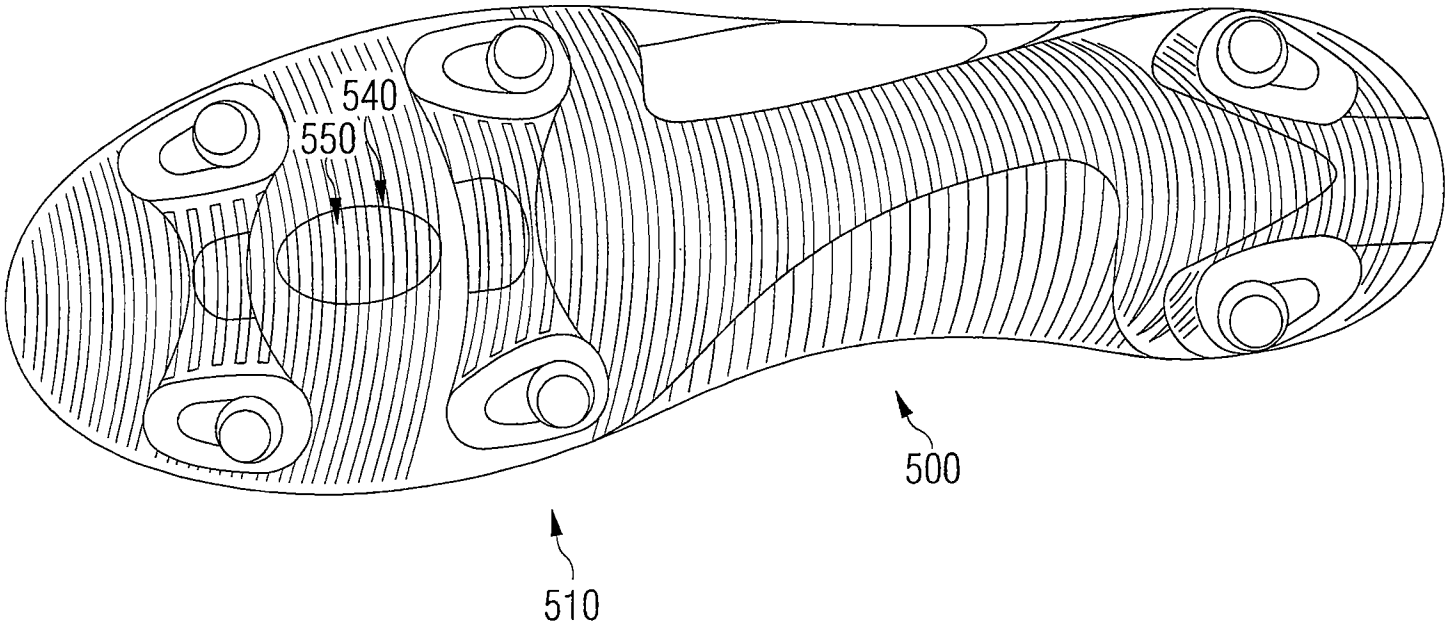
FIG. 5 is a bottom view of a football shoe with a sole having a bending element.

FIG. 5 shows a bottom view of a football shoe with a sole 500 and a bending element 550. A transparent area 540 can be recognized which may be arranged in forefoot area 510 of the second layer of sole 500 and which provides a view of bending element 550 arranged under transparent area 540.

Figure 6:
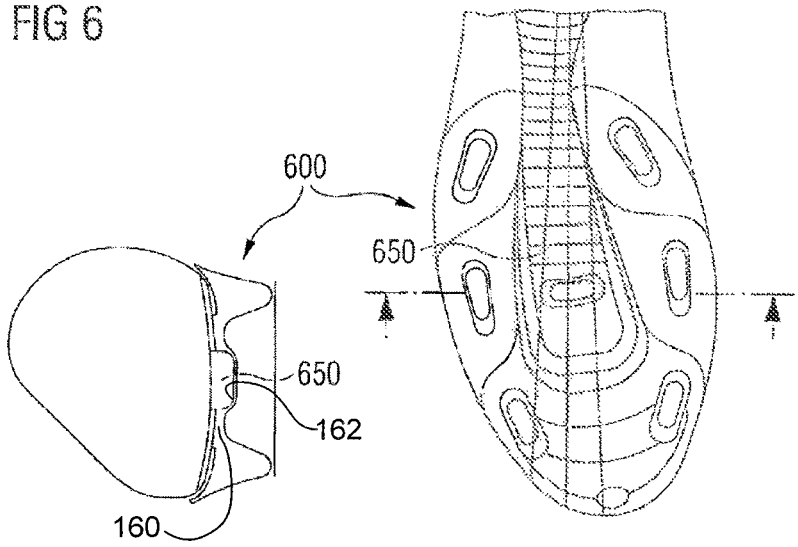
FIG. 6 is a schematic section and representation of an embodiment of a shoe with a sole having a bending element.

FIG. 6 shows schematic representations of an embodiment of a shoe with a sole and a bending element. Specifically, a bottom view of a football shoe having a sole 600 and a bending element 650 are shown. FIG. 6 further shows a cross section of the football shoe and of bending element 650.

Figure 7:
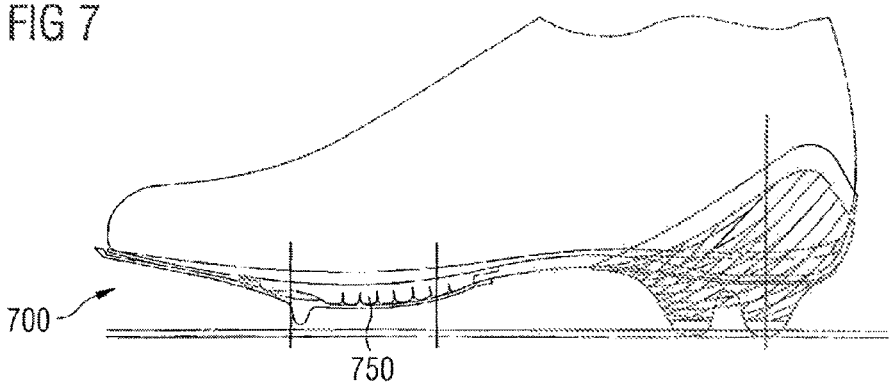
FIG. 7 is a schematic representation of an embodiment of a shoe with a sole having a bending element.

FIG. 7 illustrates a further schematic representation of a football shoe. In particular, FIG. 7 shows a schematic longitudinal section of a sole 700 having a bending element 750. As can be recognized, the thickness of bending element 750 may vary along the longitudinal axis of the shoe. Specifically, the thickness may initially increase from the midfoot area to the forefoot area and then decrease again.

Figure 8:
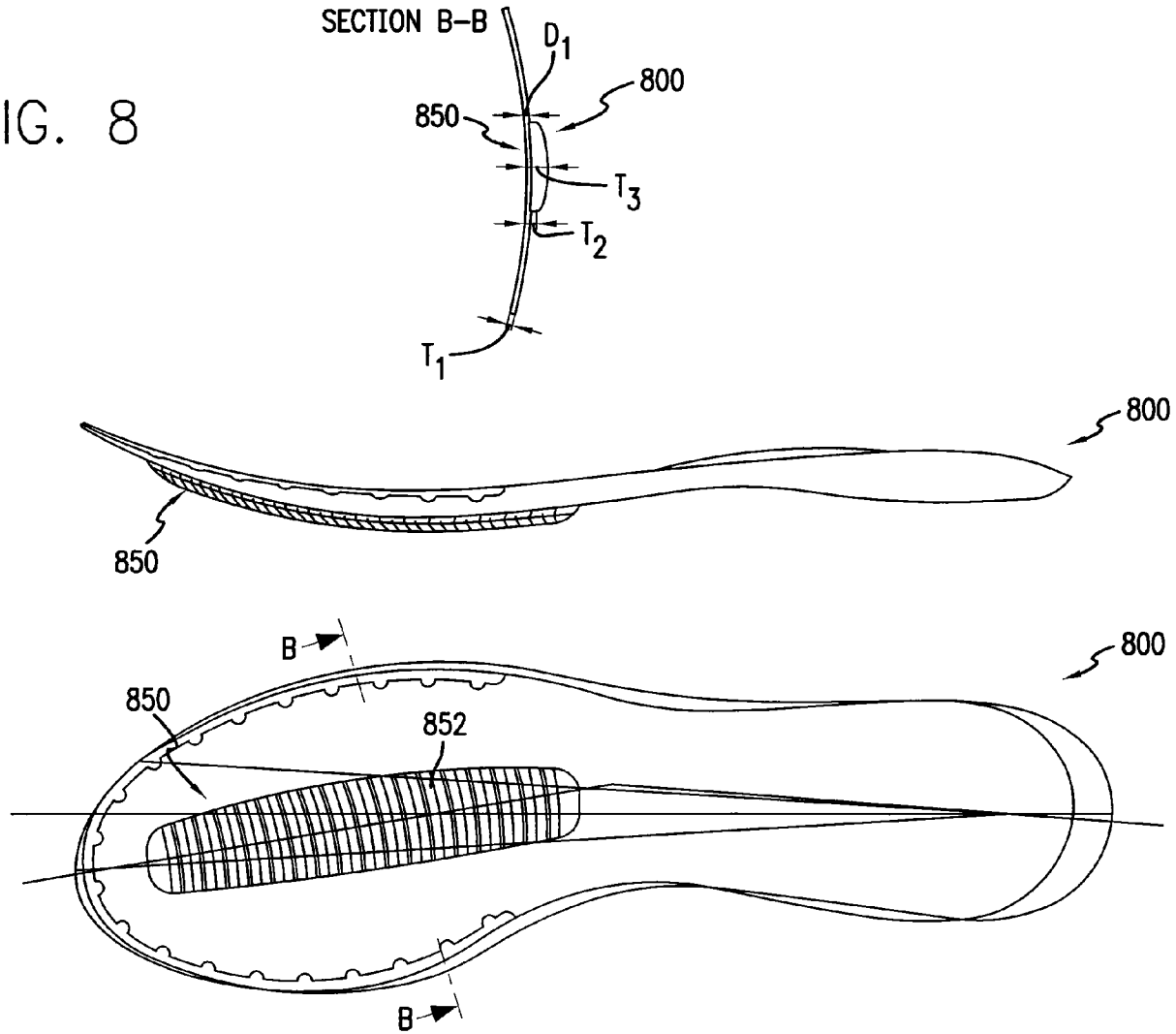
FIG. 8 is a schematic representations of an embodiment of a sole with a bending element.

Finally, FIG. 8 shows schematic representations of a further embodiment of a sole 800 having a bending element 850, in particular a side view, a cross section, and a bottom view. Bending element 850 may be arranged in the forefoot area and may extend to the toe area. The side view shows that bending element 850 may project from sole 800, wherein the thickness of bending element 850 may essentially remain constant. The bottom view of sole 800 shows that indentations 852 of bending element 850 may be curved. The cross section view of sole 800 and bending element 850 indicates sole 800 may have thickness $T_1$ of about 1.0 mm and may have an indentation having a depth $D_1$ of about 0.41 mm for receiving bending element 850. Bending element 850 may increase in thickness along its width such that bending element 850 may have a thickness $T_2$ of about 1.80 mm starting at the sides and may increase in thickness towards the center such that the center of bending element 850 may have a thickness $T_3$ of about 3.82 or 3.92 mm. These dimensions discussed above and depicted in FIG. 8 are only examples and may vary in other embodiments.

In further embodiments the bending elements in a sole can be exchanged, in order to enable adjustments to particular requirements of movements or in order to exchange defective elements. In this case, a selection between bending elements with different bending properties is possible, as for example explained above in connection with the use of different materials of a bending element. However, bending properties can also be influenced by various mechanical properties, for example different sizes of the blocks of a bending element, different distances between adjacent indentations between the blocks, or a varying thickness of the bending element.

Alternatively or in addition to an exchange, the bending elements may be designed so that they enable adaptation of the elasticity, for example by a screw which adapts an elasticity area of an elastic element of the bending element.

In further embodiments, the movement of a user of a shoe is detected by a control system using sensors, which in response correspondingly adapts the elasticity of the bending element. For example, the control system could detect the difference between a running movement and a movement for kicking or shooting a ball and correspondingly increase the elasticity during running and reduce the elasticity during a shot.

What is claimed is:

1. A sole for a shoe, comprising:

a unidirectional bending element which enables a dorsal bending of the sole and which blocks a plantar bending, wherein the sole defines an indentation for receiving the unidirectional bending element, wherein a width of the unidirectional bending element is less than half of a width of the sole, and wherein the unidirectional bending element is readily exchangeable with respect to the indentation of the sole.

2. The sole according to claim 1, wherein the unidirectional bending element is arranged in a forefoot area of the sole.

3. The sole according to claim 1, wherein the unidirectional bending element is arranged along a center line of the sole.

4. The sole according to claim 1, wherein a width of the unidirectional bending element is less than a third of a width of the sole.

5. The sole according to claim 1, wherein a width of the unidirectional bending element varies along a longitudinal axis of the sole.

6. The sole according to claim 1, wherein the unidirectional bending element extends into a toe area of the sole.

7. A sole for a shoe, comprising:

a unidirectional bending element which enables a dorsal bending of the sole and which blocks a plantar bending, wherein the unidirectional bending, element is arranged at a first layer of the sole and vertically projects from the first layer, wherein the sole comprises a second layer, wherein the second layer comprises a first cleat, and wherein the second layer defines an indentation for receiving the unidirectional bending element.

8. The sole according to claim 7, wherein the second layer further comprises a second cleat, wherein the first cleat is a medial cleat, wherein the second cleat is a lateral cleat, and wherein at least a portion of the unidirectional bending element is disposed between the medial cleat and the lateral cleat.

9. The sole according to claim 8, wherein the portion of the unidirectional bending element between the medial cleat and the lateral cleat is narrower than another portion of the unidirectional bending element.

10. The sole according to claim 7, wherein the unidirectional bending element is arranged on a side of the first layer of the sole away from a foot of a wearer.

11. The sole according to claim 7, wherein the unidirectional bending element is arranged in a recess of the first layer of the sole.

12. The sole according to claim 7, wherein the first layer of the sole is an inlay sole, an insole an intermediate sole or an outsole.

13. The sole according to claim 7, wherein;

the first layer of the sole is an inlay sole, an insole, or an intermediate sole;

the second layer of the sole is an outsole; and the outsole comprises a transparent area through which the unidirectional bending element is visible.

14. The sole according to claim 7, wherein the unidirectional bending element is exchangeable.

15. The sole according to claim 7, wherein the unidirectional bending element comprises blocks which are separated by indentations.

16. The sole according to claim 15, wherein the unidirectional bending element further comprises a plastic plane to which the blocks are attached.

17. The sole according to claim 15, wherein distances between adjacent indentations in the direction of a longitudinal axis of the unidirectional bending element are different from each other.

18. The sole according to claim 15, wherein the unidirectional bending element is curved in its initial state in a side view.

19. The sole according to claim 15, wherein the blocks of the unidirectional bending element comprise materials with different properties.

20. A shoe comprising a sole according to claim 1.

21. The shoe according to claim 20, wherein the sole comprises an indentation for the unidirectional bending element.

22. A sole for an article of footwear, comprising:

a unidirectional bending element comprising a base and a plurality of blocks extending from the base, wherein the plurality of blocks are separated by indentations extending across a width of the unidirectional bending element, wherein when the plurality of blocks are moved in a dorsal direction, the plurality of blocks are capable of moving away from each other to thereby permit a dorsal bending of the sole, wherein when the plurality of blocks are moved in a plantar direction, the plurality of blocks contact each other to impede movement to thereby restrict plantar bending of the sole, and wherein the width of the unidirectional bending element is less titan half a width of the sole at every point along the entire length of the unidirectional bending element.

23. The sole according to claim 1, wherein the width of the unidirectional bending element is less than half of the width of the sole at the same point.

24. The sole according to claim 1, wherein the width of the unidirectional bending element is less than a third of the width of the sole at the same point.

25. The sole according to claim 1, wherein the width of the unidirectional bending element is less than half of the width of the sole at every point along the length of the unidirectional bending element.

26. The sole according to claim 1, wherein the width of the unidirectional bending element is less than a third of the width of the sole at every point along the length of the unidirectional bending element.

* * * * *

UNITED STATES PATENT AND TRADEMARK OFFICE

CERTIFICATE OF CORRECTION

PATENT NO. : 8,522,457 B2
APPLICATION NO. : 12/645452
DATED : September 3, 2013
INVENTOR(S) : Scholz et al.

It is certified that error appears in the above-identified patent and that said Letters Patent is hereby corrected as shown below:

In the Claims

Column 10, line 55 (claim 12): "an insole an intermediate sole" should read --an insole, an intermediate sole--.

Signed and Sealed this
Fifth Day of November, 2013

Teresa Stanek Rea
*Deputy Director of the United States Patent and Trademark Office*